United States Patent [19]

Urai

[11] Patent Number: 4,660,888

[45] Date of Patent: Apr. 28, 1987

[54] SEAT COVER

[75] Inventor: Muneharu Urai, Tokyo, Japan

[73] Assignee: Tachikawa Spring Co., Tokyo, Japan

[21] Appl. No.: 788,490

[22] Filed: Oct. 17, 1985

[51] Int. Cl.[4] ..... A47C 7/02

[52] U.S. Cl. ..... 297/452; 66/171; 297/218

[58] Field of Search ..... 297/452, 218, 219; 66/171

[56] References Cited

U.S. PATENT DOCUMENTS

| | | | |
|---|---|---|---|
| 2,266,678 | 12/1941 | Krasnov et al. | 297/224 X |
| 2,921,625 | 1/1960 | Krasnov et al. | 297/224 |
| 2,962,885 | 12/1960 | Knohl | 66/171 X |
| 3,337,884 | 8/1967 | Meier | 297/219 X |
| 3,519,308 | 7/1970 | Kasman et al. | 297/218 |
| 4,103,968 | 8/1978 | Butterfield | 297/219 |
| 4,141,229 | 2/1979 | Sharpe | 66/171 |
| 4,478,453 | 10/1984 | Schutz | 297/224 X |

FOREIGN PATENT DOCUMENTS 112579 7/1983 Japan .

*Primary Examiner*—James T. McCall

*Attorney, Agent, or Firm*—Oldham, Oldham & Weber Co.

[57] ABSTRACT

A seat cover comprises a knitting of a three-dimensional structure conforming in its external shape to that of a seat and including at least main portions, side portions and welt portions integrally knit into a one-piece form. The knitting further includes integrally knit portions covering overhang portions and corner portions of the seat and/or rear and bottom portions of a front back of the seat.

11 Claims, 9 Drawing Figures

SEAT COVER

BACKGROUND OF THE INVENTION

This invention relates to a seat cover which is novel in design and can be manufactured at low cost.

DESCRIPTION OF THE PRIOR ART

FIG. 1 is a perspective view showing the external appearance of various portions of a prior art trim cover (or simply a cover) used for covering a seat cushion composed of a front cushion FC and a front back FB which are prepared separately and joined together at a joint (not shown).

Referring to FIG. 1, the cover generally designated by the reference numeral 1 includes main portions 1*a*, rim portions 1*b*, side portions 1*c*, welts 1*d*, corner portions 1*e*, overhang portions H, and machine-sewn portions (or high-frequency welded portions) M.

The prior art trim cover 1 is divided into a plurality of surface coverings each including a main portion 1*a*, rim portions 1*b*, side portions 1*c* and/or a welt 1*d*, or a filler pad (not shown) and a backing cloth are cut into a plurality of sections, and they are joined together by machine sewing or high-frequency welding. Such a cover is used to cover a cushion member of molded polyurethane to constitute a seat.

As another prior art example, there is a seat in which a single surface covering molded from a synthetic resin or like material is bonded by a bonding agent to a cushion member of molded polyurethane. However, in each of the prior art examples, it is very difficult or almost impossible to provide a single surface covering which includes the overhang portions H, corner portions 1*e*, welts 1*d* in addition to the portions 1*a*, 1*b* and 1*c* and which can also cover the back side (not shown) of the front back FB.

As described above, it has been difficult to accurately configure the external shape of a prior art trim cover for a seat. Further, the prior art trim cover has been defective in that many labors are required and materials are considerably wasted, resulting high manufacturing costs.

As also described above, the prior art cover is provided by combining a plurality of surface coverings. Thus, it has been quite difficult or almost impossible to deal with a variety of design requirements including formation of a desired pattern by locally modifying the mode of knitting or changing the fabric material within a single peace of surface covering or formation of various patterns or characters by locally changing the color and size of threads.

SUMMARY OF THE INVENTION

With a view to obviate the prior art disadvantages described above, it is a primary object of the present invention to provide a novel seat cover which can deal with a variety of design requirements and can reduce the manufacturing cost.

DESCRIPTION OF THE PREFERRED EMBODIMENTS

Figure 1:
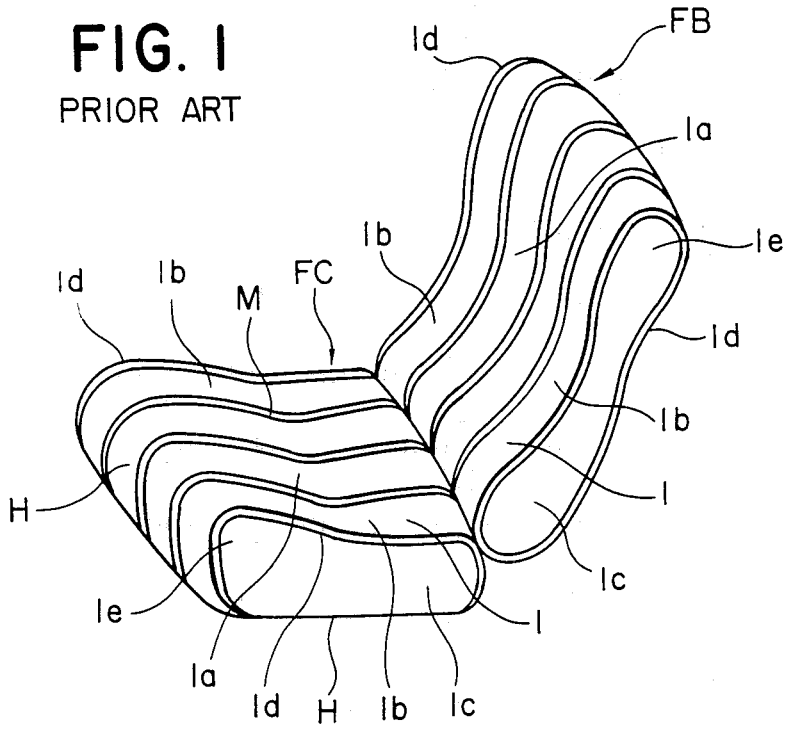
FIG. 1 PRIOR ART
FIG. 1 is a perspective view showing various parts of a prior art seat cover.

Preferred embodiments of the present invention will now be described in detail with reference to the accompanying drawings in which like reference numerals are used to designate like parts appearing in FIG. 1.

Figure 2:
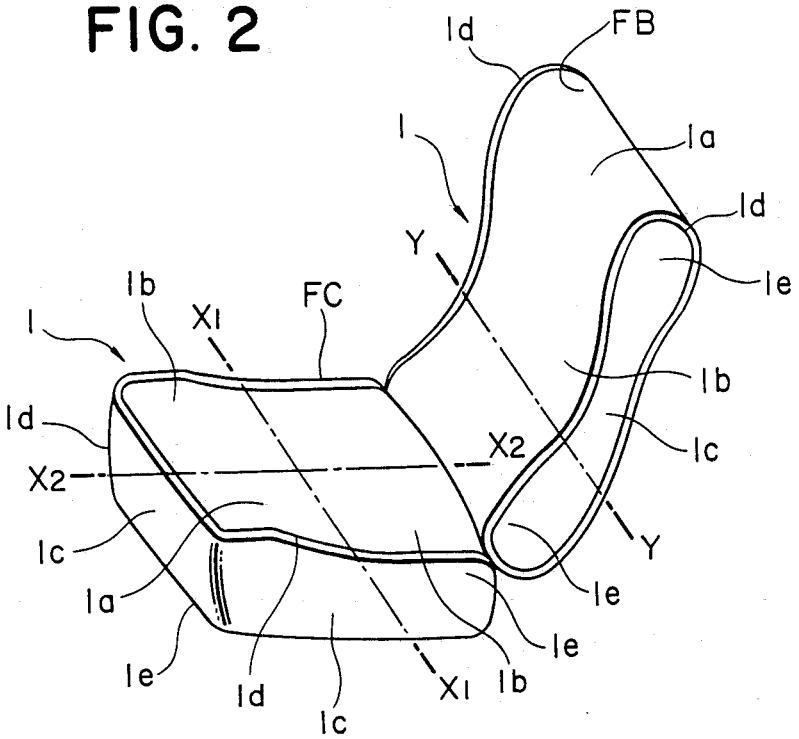
FIG. 2 is a perspective view of an embodiment of the seat cover according to the present invention.
Figure 3:
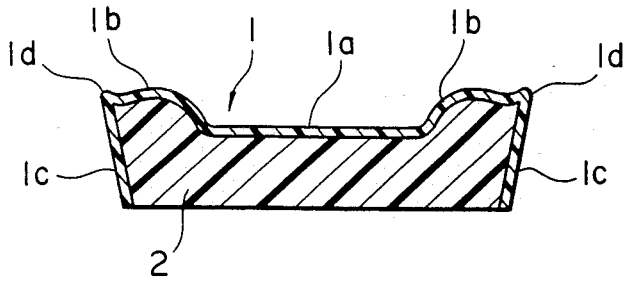
FIG. 3 is a sectional view taken along the line $X_1$—$X_1$ in FIG. 2.
Figure 5A:
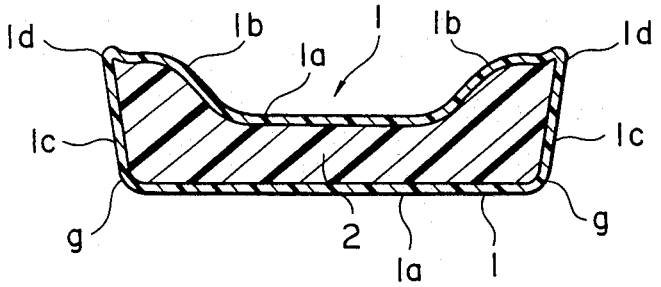
FIG. 5*a* is a sectional view taken along the line Y—Y in FIG. 2.
Figure 5B:
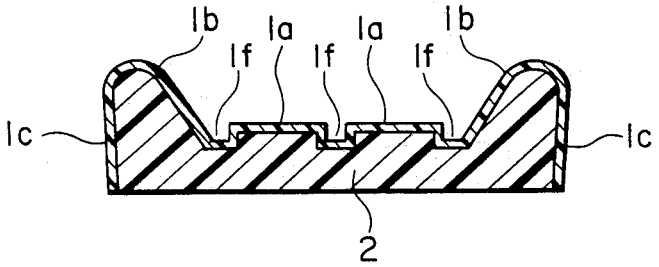
FIG. 5*b* is a sectional view of a modification in which channels are formed on the surface of the part shown in FIG. 5*a*.

FIG. 2 is a perspective view showing various parts of a preferred embodiment of the seat cover according to the present invention, FIG. 3 is a sectional view taken along the line $X_2$—$X_2$ in FIG. 2, FIG. 5*a* is a sectional view taken along the line Y—Y in FIG. 2, and FIG. 5*b* is a sectional view of a modification in which channels are formed on the surface of the part shown in FIG. 5*a*.

Figure 4:
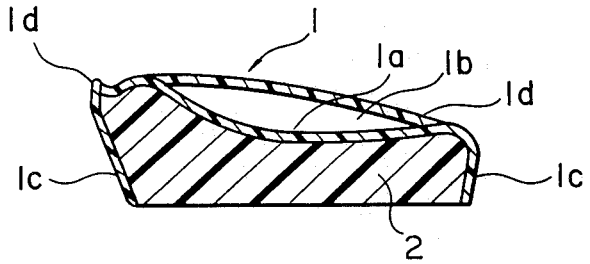
FIG. 4 is a sectional view taken along the line $X_2$—$X_2$ in FIG. 2.

FIG. 2 shows the external appearance of the cover 1 embodying the present invention. Referring to FIG. 2, the cover 1 comprises a knitting of a one-piece three-dimensional structure conforming in its external shape to that of a block of molded polyurethane (FIGS. 3 to 5). Thus, portions including main portions 1*a*, rim portions 1*b*, side portions 1*c*, welt portions 1*d* and cover portions 1*e* are integrally formed on the one-piece cover 1.

FIGS. 2, 3 and 4 illustrate that the side portions 1*c* are in the form of an overhang.

The cover 1 is secured at least part thereof to a cushion member 2 by a bonding agent, a velcro tape (a velvet fastener) or a suspension strap.

FIG. 5*a* illustrates that the part of the cover 1 covering the front back FB has a three-dimensional shape in which the surface covering and the backing are integrally knit into a bag form. The side portions 1*c* of the part shown in FIG. 5*a* are not generally in the form of an overhang. Depending on the specification, the surface covering and the backing of the cover 1 may be divided at portions g and separately prepared to be combined at the portions g. The backing may be a fabric material or a sheet of artificial leather known as vinyl leather.

FIG. 5*b* shows a modification in which channels 1*f* are formed on part of the main portion 1*a* of FIG. 5*a*, and the welts 1*d* are eliminated.

Although the front cushion FC and the front back FB in the embodiment shown in FIG. 2 are illustrated as separate parts, they may be integrated into a one-piece cover (not shown).

One or more of various modes of knitting are applied to the main portions 1*a*, rim portions 1*b* and side portions 1*c* of the cover 1 according to the present invention.

Among the various modes of knitting, gathered stitching, pleated pattern stitching and pin-tuck stitching are applied to the rim portions 1*b*, side portions 1*c*, etc.

Projections of a diagonal pattern or projections of an double pleats pattern are suitably applied to form the welts 1*d*.

An embroidery can be applied to, for example, the main portion 1*a* of the front back FB.

Buttonhole hemstitching is applied to the hem of a hole where a rod connecting the head rest to the front back FB or an actuating handle extends through the cover 1.

Although not shown, characters, for example, "TURBO" may be displayed at an upper portion of the main portion 1*a* of the front back FB by embroidering a thread whose color or size differs from that of the thread forming the remaining of the main portion 1*a*. It is apparent that, by a suitable combination of threads having different colors and sizes, more designs can be provided.

The present invention is not limited to the combinations of various decorative patterns described above, and a variety of any other designs may be combined to realize new design modes which have not been realized yet.

Figure 6A:
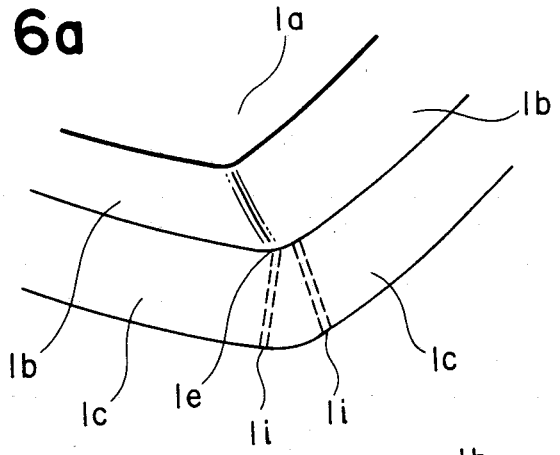
FIGS. 6*a* and 6*b* are perspective view of part of the cover when the cover includes a curved portion and a curved surface respectively.
Figure 6B:
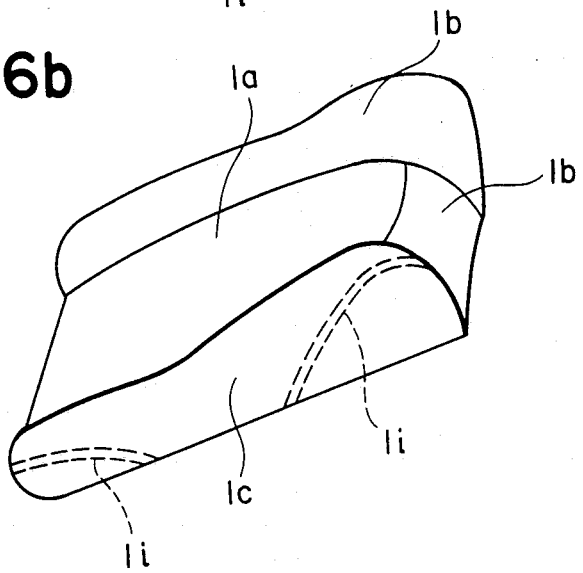

FIGS. 6*a* and 6*b* illustrates that, at the portions such as the corner portions 1*e*, and overhang side portions 1*c* where the cover 1 has a sharply changing curved surface or contour, angular turnbacks 1*i* may be provided by any one of the pin-tuck stitching, gathered stitching and pleated pattern stitching or returning coruse stitching.

Figure 7:
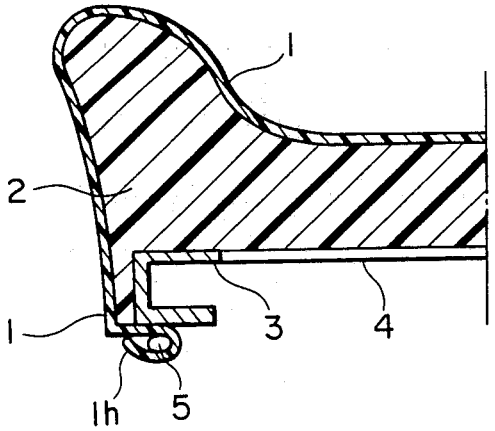
FIG. 7 is a sectional view of a modification in which the longitudinal end edges of the cover are each shaped in the form of a bag.

A monner of securing the cover 1 will be described with reference to a modification shown in FIG. 7. Referring to FIG. 7, the longitudinal end edges of the cover 1 are each shaped in the form of a bag 1*h*, and a cord 5 is passed inside the bag-shaped end edges 1*h*. Then, the both ends of the cord 5 are pulled, or a rubber string is passed in lieu of the cord 5, to secure the cover 1 to a frame 3.

The cover according to the present invention is applicable not only to seats but also to the interior of a vehicle's compartment including door pads, head rests, arm rests, a console box and a ceiling member and also to articles of furniture. Further, the material of the cover is not limited to a knit fabric, and a combination of a knit fabric and a woven fabric may be shaped into a one-piece three-dimensional structure.

Various advantages including capability of exhibition of a variety of seat cover designs, saving of materials, saving of labors and reduction of costs can be achieved by the employment of the cover of the present invention. Also, the present invention eliminates the necessity for trial manufacture of covers by machine sewing and provides such a psychological effect that a person who may be a vehicle driver can feel a different touch or change his mind when the seat cover is replaced to match the summer or winter season. Further, the cover of the present invention can be applied to cover a conventional cover used hitherto or can easily replace an old-fashioned one.

What is claimed is:

1. A seat cover comprising a knitting of a three-dimensional structure conforming in its shape to the external shape of a cushion member and including at least main portions, side portions and welt portions integrally knit into a one-piece form without sewing, said structure further including integrally knit portions covering overhang portions and corner portions of the seat.

2. A seat cover as claimed in claim 1, wherein various decorative patterns are locally formed by pattern knitting.

3. A seat cover as claimed in claim 1, wherein threads of different colors and sizes are knit to locally form characters.

4. A seat cover as claimed in claim 1, wherein buttonhole hemstitching is applied to the hem of a hole of said knitting where a rod for connection to a head rest of the seat or an actuating handle extends through said cover.

5. A seat cover as claimed in claim 1, wherein the parts of said cover corresponding to a front cushion and a front back of the seat respectively are joined together as by machine sewing.

6. A seat cover as claimed in claim 1, wherein said cover is configured into the three-dimensional shape by joint use of a knit fabric and a woven fabric.

7. A seat cover as claimed in claim 1 where the cushion member has sharply changing curved surfaces in the overhang and corner portions thereof and angular turnbacks formed by stitching are provided in corresponding portions of the seat cover to have the seat cover snuggly engage the cushion member.

8. A seat cover as claimed in claim 1 wherein said welts are eliminated and replaced by channels formed on a part of said main portion.

9. A seat cover comprising a knitting of a three-dimensional structure conforming in its shape to the external shape of a cushion member and including at least main portions, side portions and welt portions integrally knit into a one-piece form without sewing, said structure further including integrally knit portions covering overhang portions and corner portions of a seat base and front and back portions of a front back of the seat.

10. A seat cover as claimed in claim 9, wherein the welt portions are locally formed by pattern knitting.

11. A seat cover as claimed in claim 9, wherein threads of different colors and sizes are knit to locally form decorative patterns.

* * * * *